US006708369B1

(12) United States Patent
Liao

(10) Patent No.: US 6,708,369 B1
(45) Date of Patent: Mar. 23, 2004

(54) ADJUSTABLE TOP HOLDER

(76) Inventor: Shou-Hsing Liao, 5F No. 159, Sec. 1 Hua-Mei W. Street, Taichung City (TW)

( * ) Notice: Subject to any disclaimer, the term of this patent is extended or adjusted under 35 U.S.C. 154(b) by 0 days.

(21) Appl. No.: 10/259,730

(22) Filed: Sep. 30, 2002

(51) Int. Cl.[7] ..... E05D 7/04
(52) U.S. Cl. ..... 16/252; 16/239; 52/204.58
(58) Field of Search ..... 16/252, 253, 235, 16/233, 238, 239, 240, DIG. 39, DIG. 40; 52/204.58, 204.54, 204.53, 204.62, 204.65, 204.66, 656.4, 656.9; 49/501, 399, 388

(56) References Cited

U.S. PATENT DOCUMENTS 2,284,409 A * 5/1942 Erath ..... 52/782.1
3,604,154 A * 9/1971 Curran ..... 49/501
3,685,240 A * 8/1972 Oscari ..... 52/235
3,828,394 A * 8/1974 Horgan, Jr. ..... 16/241
4,513,474 A * 4/1985 Watabe ..... 16/243
4,523,414 A * 6/1985 Horgan, Jr. ..... 52/204.1
4,785,498 A * 11/1988 Brotschi ..... 16/238
5,297,313 A * 3/1994 Brin ..... 16/252
6,363,547 B1 * 4/2002 Perry ..... 4/614
6,381,909 B1 * 5/2002 Liao ..... 52/204.58
6,609,335 B1 * 8/2003 Hyakkoku ..... 49/388
2002/0189178 A1 * 12/2002 Lind ..... 52/235

* cited by examiner

*Primary Examiner*—Anthony Knight
*Assistant Examiner*—André L. Jackson
(74) *Attorney, Agent, or Firm*—Bacon & Thomas

(57) ABSTRACT

An adjustable top holder comprises a pivotal strut assembly and an anchor assembly that consist of a plurality of anchor components and a plurality of anchor disks for protecting and anchoring tempered glasses. The pivotal strut assembly includes a first vertical rod, a first transverse rod and a pivotal strut. The anchor assembly includes a second vertical rod, a third vertical rod and a second transverse rod. The invention is made and assembled from cylindrical bars without using molds. Thus production cost is greatly reduced. In addition, the vertical rods and the transverse rods may be switched between the right side and the left side to increase flexibility and interchangeability. Production and warehousing costs and space also are reduced The invention provides multiple functions and a greater versatility.

5 Claims, 8 Drawing Sheets

ADJUSTABLE TOP HOLDER

FIELD OF THE INVENTION

The present invention relates to a holder of a glass door and particularly a top holder for a tempered glass door with adjustable fastening positions to anchor the glass door to increase application versatility.

BACKGROUND OF THE INVENTION

A conventional reinforced and tempered glass door for shops and stores generally includes a plurality of tempered glass panels. FIG. 1 illustrates a glass door which consists of five glass panels 1, i.e. a left panel, a right panel, a top panel and two door panels. The door panels are coupled with corner transom fittings 2 for anchoring and opening use. Assembly and installation of the glass panels 1 and the corner transom fittings 2 usually requires several people. Referring to FIG. 2, each corner transom fitting 2 generally consists of two symmetrical seats 3, matching pads 4, washers 5 and fastening bolts 6 for clamping the glass panel 1. To install the corner transom fitting 2 on the glass panel 1, several people should be on site for help. Some hold the glass panels 1 on the side and top, others hold the seats 3 and necessary tools to do fastening The installation job takes a lot of manpower and is tedious and cumbersome. With increasing labor costs and growing awareness of labor benefits, and fierce competition on the market and decreasing profit margins, how to perform same kind of work with less manpower is essential to increase profit and market competitiveness. On glass door assembly and installation, there is still room for improvement.

In order to resolve the foregoing disadvantages, Applicant has disclosed a design and obtained a U.S. Pat. No. 6,381,909, entitled: "Corner transom fitting for framesless tempered glass door". It mainly includes a seat with two sections. The seat consists of three pieces. It may be assembled and installed by a few people to reduce labor costs.

However it still has some drawbacks, notably:

1. The components have to be made by molds. Production cost becomes higher.
2. The tempered glass must have holes formed thereon for installation. The holes must be located and made precisely. Once drilled and formed, they cannot be changed. However, when a plurality of glass panels are assembled and installed, they always, have gaps of various sizes among them. As the apertures on the seats of the corner transom fittings also are fixed, it is difficult to accurately install the corner transom fitting on the tempered glass panels.

SUMMARY OF THE INVENTION

The primary object of the invention is to overcome the drawbacks mentioned above. The invention employs cylindrical vertical rods, transverse rods and a pivotal strut that are made without using molds, thus can greatly reduce production cost. They can be fabricated rapidly by lathe machining. The vertical rods have transverse holes and step holes to provide bi-directional fastening so that the invention may be switched between the right side and the left side to increase flexibility and interchangeability. As a result, production and warehousing costs and space can be reduced. Moreover, the holes on the vertical rods have a greater diameter than the fastening bolts so that the invention may be accurately, installed on the tempered glass panels even if there are gaps of various sizes occurred to the tempered glass panels.

To achieve the foregoing object, the invention includes a pivotal strut assembly and an anchor assembly that consists of a plurality of anchor means and anchor disks. The pivotal strut assembly further includes a first vertical rod, a first transverse rod and a pivotal strut. The anchor assembly includes a second vertical rod, a third vertical rod and a second transverse rod. The rods and strut are made from cylindrical bars without the need of molds, Thus fabrication cost can be greatly reduced. In addition, the vertical rods and the pivotal strut may be switched between the left side and the right side to increase flexibility and interchangeability. This also helps to decrease production and warehousing costs and space.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
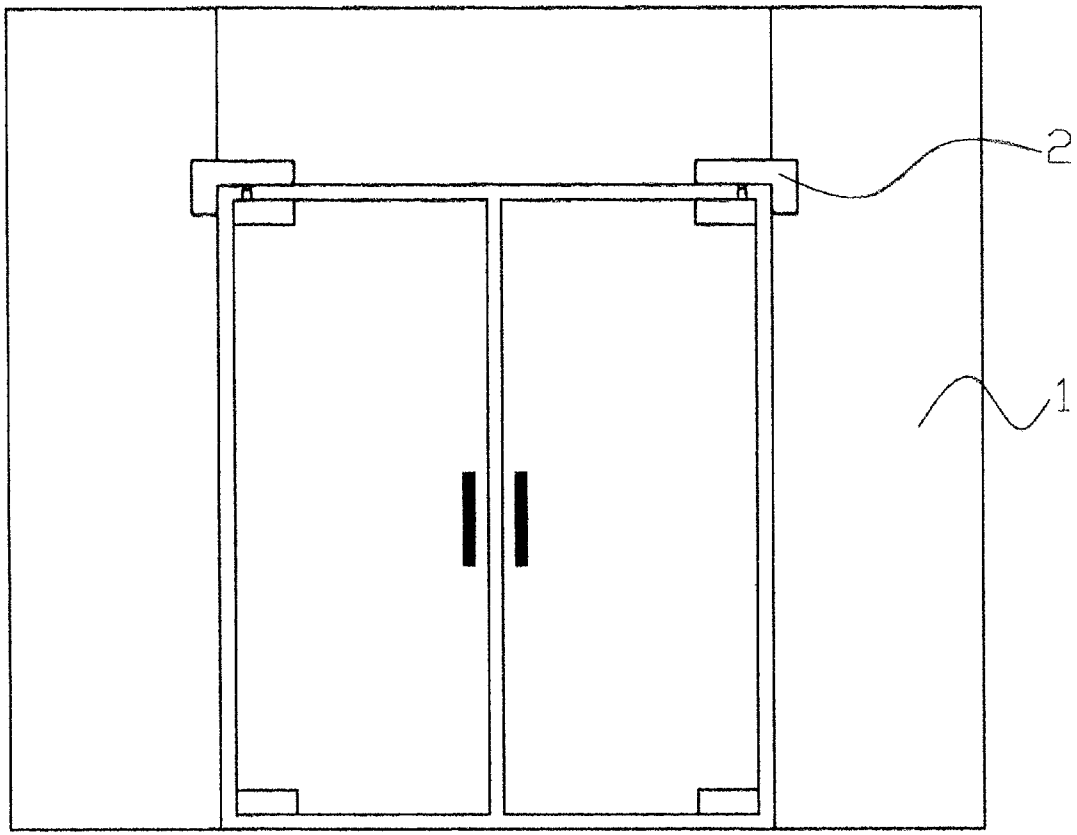
FIG 1. PRIOR ART
FIG. 1 is a front view of a conventional five-piece tempered glass door.
Figure 2:
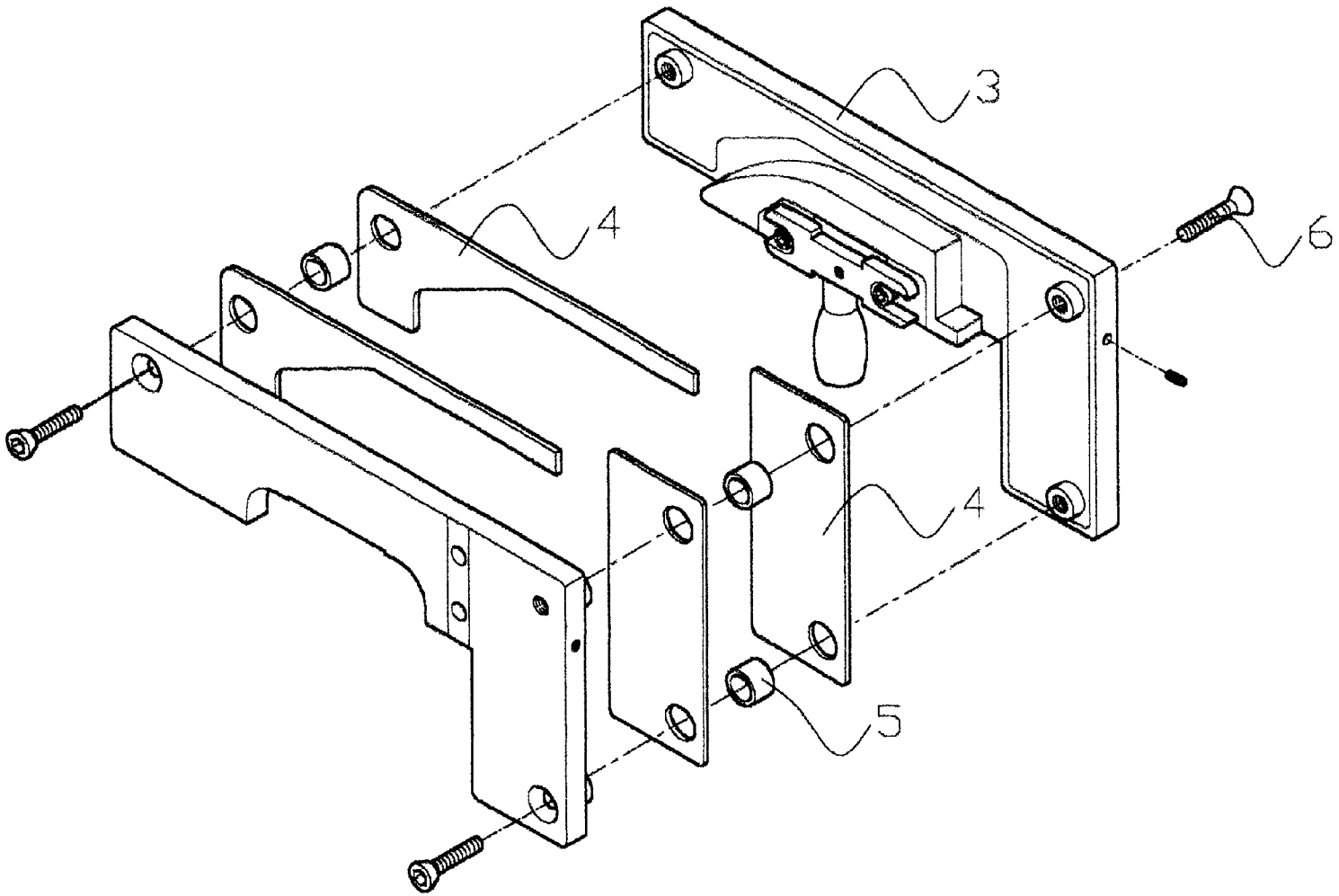
FIG 2. PRIOR ART
FIG. 2 is an exploded view of a conventional corner transom fitting for a glass door.
Figure 3:
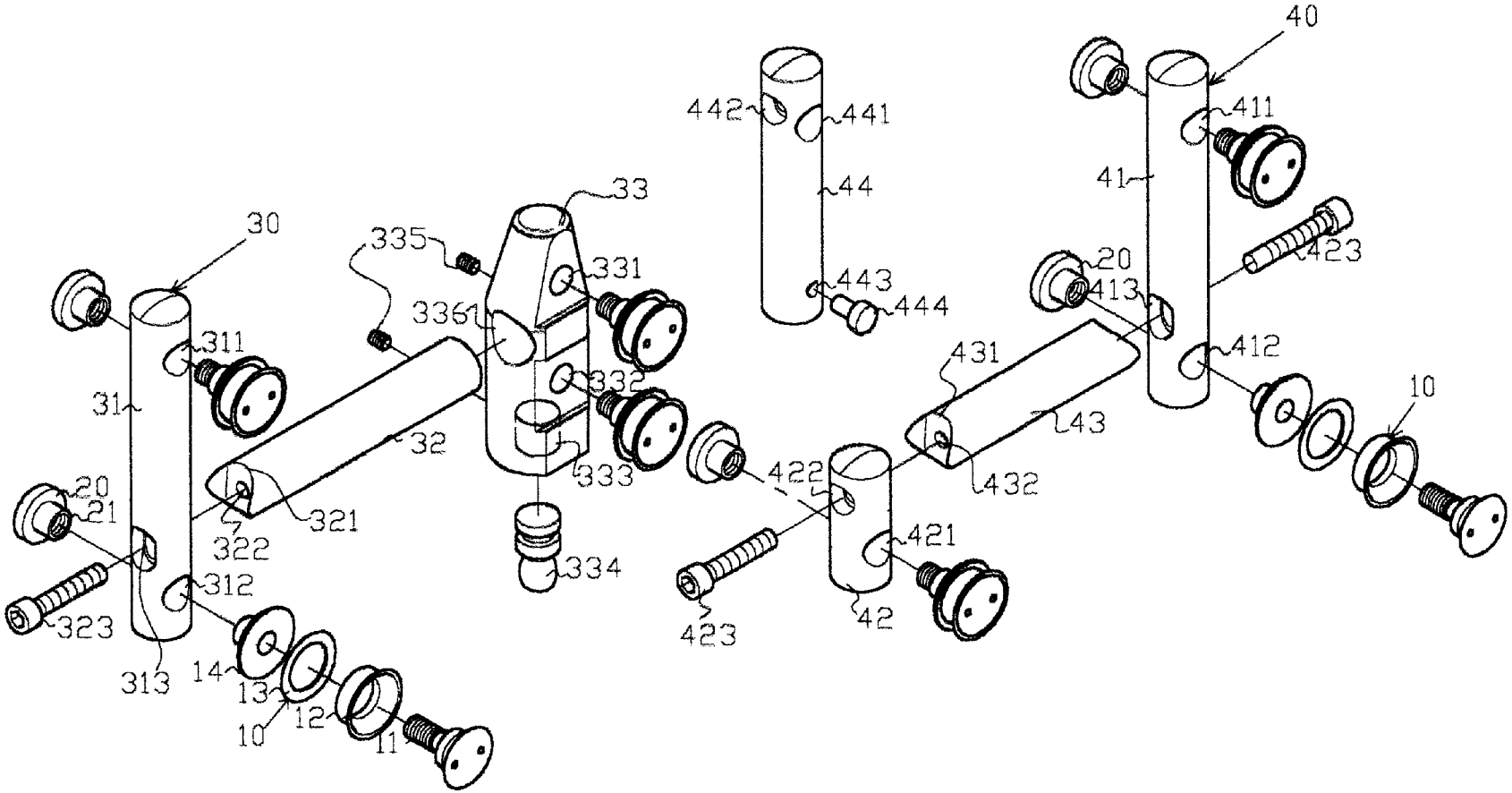
FIG. 3 is an exploded view of the invention.
Figure 5:
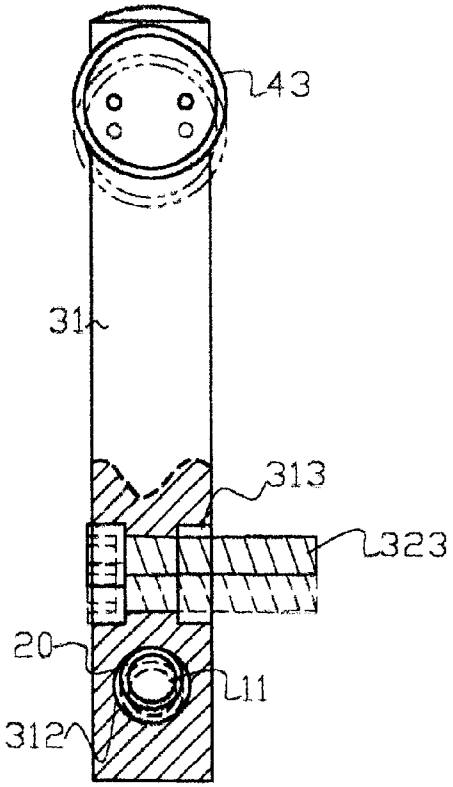
FIG. 5 is a schematic view of the invention in use, partly cutaway.
Figure 4:
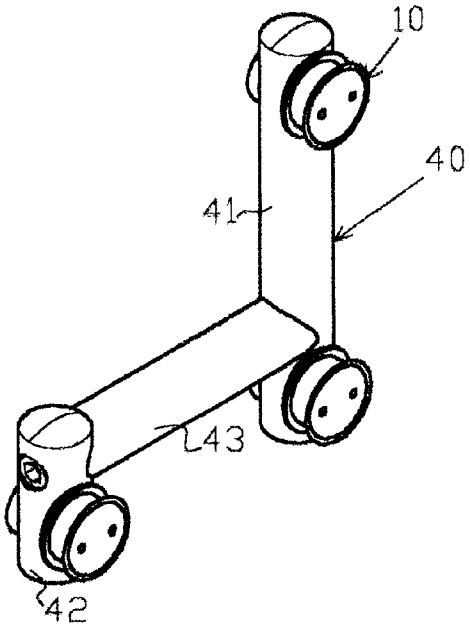
FIG. 4 is a perspective view of the invention.
Figure 4:
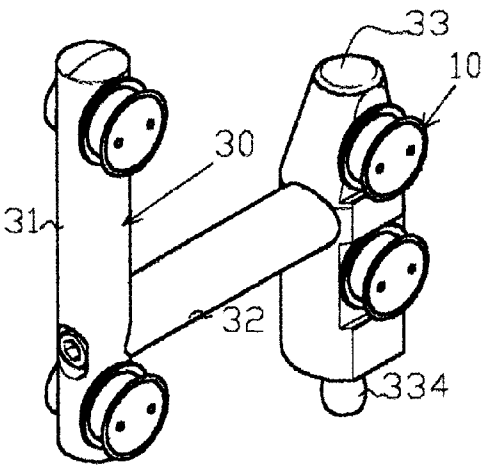

Referring to FIGS. 3 and 4, the invention mainly consists of:

- a plurality of anchor means 10 each has a fastening bolt 11 coupling with a protective ring 12, a washer 13 and an anchor bushing 14 for holding a tempered glass 50 between the protective ring 12 and the washer 13. The fastening bolt 11 has two small cavities formed on the surface thereof to engage with a selected tool for fastening or unfastening (not shown in the drawings);
- a plurality of anchor disks 20 each has a screw hole 21 to engage with the fastening bolt 11 of the anchor means 10 and two small cavities formed on the surface thereof to engage with a selected tool for fastening or unfastening (not shown in the drawings);
- a pivotal strut assembly 30 including:
  - a first vertical rod 31 which has a first aperture 311 and a second aperture 312 located respectively on an upper and a lower portion thereof at desired positions for fastening the anchor means 10 and the anchor disk 20. The apertures 311 and 312 have a diameter greater than the diameter of the fastening bolt 11 as shown in FIG. 5. The first vertical rod further has a transverse hole 313 formed between the first and the second apertures 311 and 312. The transverse hole 313 is an extended round bi-directional stepwise hole crossing the first and the second apertures 311 and 312 in a normal manner but not communicating with them;

a first transverse rod 32 which has one end formed a trough 321 to match and contact the perimeter,of first vertical rod 31 in a cross manner. The trough 321 has a screw hole 322 coincided axially with the transverse hole 313 of the first vertical rod 31 such that a set screw 323 may be used to run through the transverse hole 313 to engage with the screw hole 322 to fasten the first transverse rod 32 to the first vertical rod 31 in a normal and cross manner; and a pivotal strut 33 formed in a bullet shape having a first screw hole 331 and a second screw hole 332 located respectively on an upper portion and a lower portion thereof at desired positions for fastening one anchor means 10. The pivotal strut 33 further has the bottom end formed a cavity 333 for holding an axle 334 which is fastened and anchored by a set screw 335. The pivotal strut 33 also has a transverse hole 336 crossing between the first and the second screw holes 331 and 332 in a normal manner but not communicating with them. The first transverse rod 32 may run through the transverse hole 336 until reaching a desired position and be fastened by another set screw 335; and an anchor assembly 40 including:

a second vertical rod 41 which is identical with the first vertical rod 31 and has a third aperture 411 and a fourth aperture 412 located respectively on an upper and a lower portion thereof at desired positions for fastening the anchor means 10 and the anchor disk 20. The apertures 411 and 412 have a diameter greater than the diameter of the fastening bolt 11. The second vertical rod further has a transverse hole 413 formed between the third and the fourth apertures 411 and 412. The transverse hole 413 is an extended round bi-directional stepwise hole crossing the first and the second apertures 411 and 412 in a normal manner but not communicating with them;

a third vertical rod 42 having a fifth aperture 421 located at a desired position with a diameter greater than the diameter of the fastening bolt 11 for fastening the anchor means 10 and the anchor disk 20. The third vertical rod 42 has a round bi-directional first stepwise hole 422 located on an upper portion thereof crossing the fifth aperture 421 in a normal manner but not communicating with it; and a second transverse rod 43 located between the second and the third vertical rods 41 and 42 having two ends formed respectively a semicircular trough 431 to contact the perimeter of the second and the third vertical rods 41 and 42 in a cross and normal manner. The trough 431 has a screw hole 432 coincided axially with the first stepwise hole 422 hole of the second and the third vertical rods 41 and 42 such that a set screw 423 may be used to run through the first stepwise hole 422 to engage with the screw hole 432 to fasten and bridge the second transverse rod 43 between the second and the third vertical rods 41 and 42.

Figure 9:
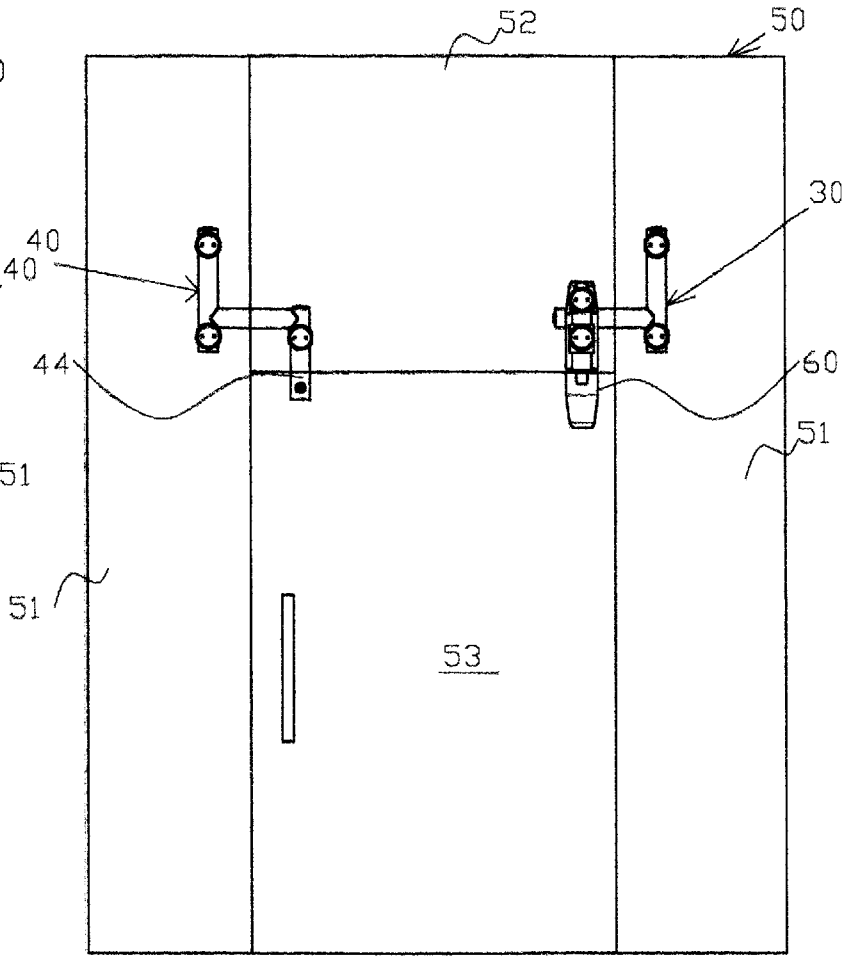
FIG. 9 is a schematic view of a variation of the invention in a use condition.
Figure 6:
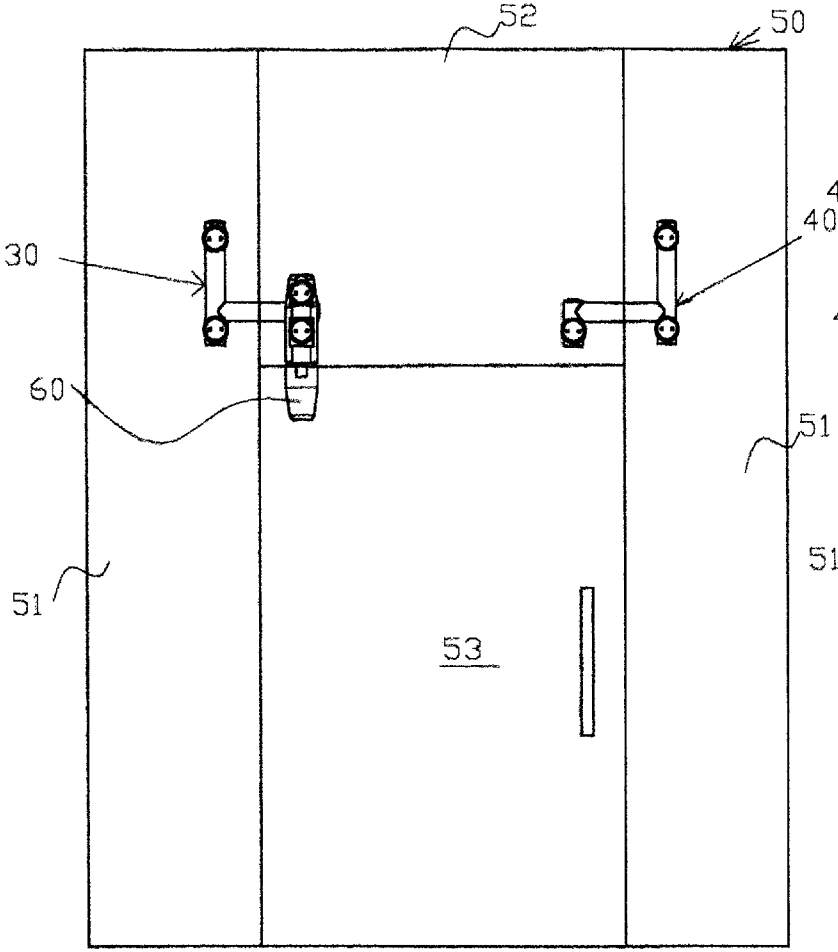
FIG. 6 is a schematic view of the invention in a use condition.

Refer to FIGS. 3, 4 and 6 for the invention adopted on a single panel door that is openable at two sides. The tempered glass 50 is held and anchored through the anchor means 10 of the invention. When there are gaps occurred between the two side glass panels 51 and the top glass panel 52, the first and second transverse rods 32 and 43 may be moved up or down (as shown in FIG. 5) for adjustment because the extended round transverse holes 313 and 413 has a greater diameter than the fastening bolts 11 held therein (as shown in FIG. 5), and the distance of the anchor means 10 may be adjusted slightly to fit the holes (not shown in the drawings) formed on the tempered glass 50. The tempered glass door 53 has an anchor strut 60 mounted on a location matching the pivotal strut 33 to serve as the turning axis to make the glass door 53 turnable for opening and closing. The invention may also be adopted for a single door with only opening function as shown in FIG. 9. In such a situation, the third vertical rod 42 may be transformed to a fourth vertical rod 44. As shown in FIG. 3, the fourth vertical rod 44 has an aperture 443 located on a lower section to couple with a stop pad 444 to stop and cushion the glass door 53 during closing, and to prevent the glass door 53 from directly hitting the fourth vertical rod 44.

Figure 7:
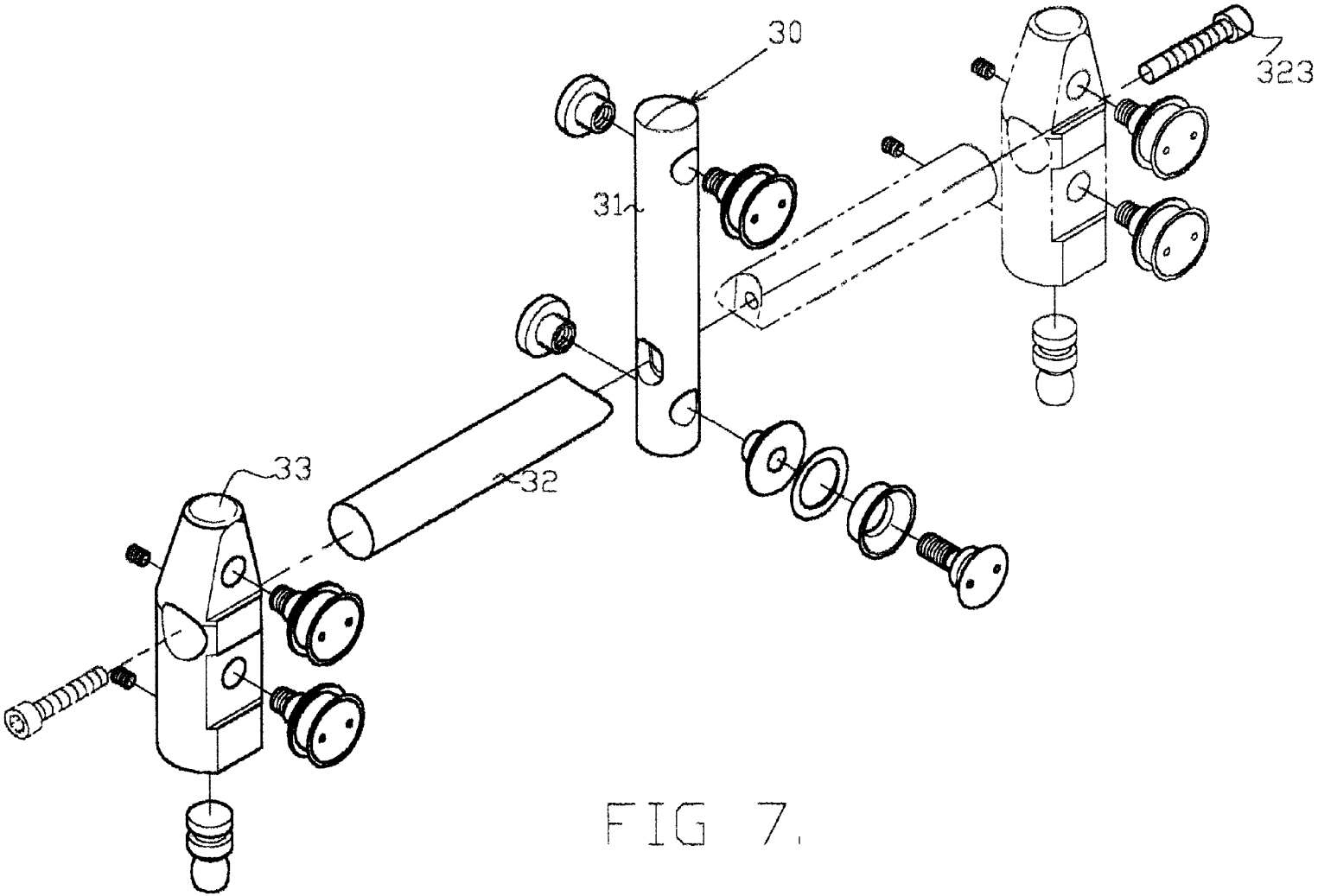
FIG. 7 is an exploded view of the invention in another use condition, with the pivotal strut assembly altered.
Figure 8:
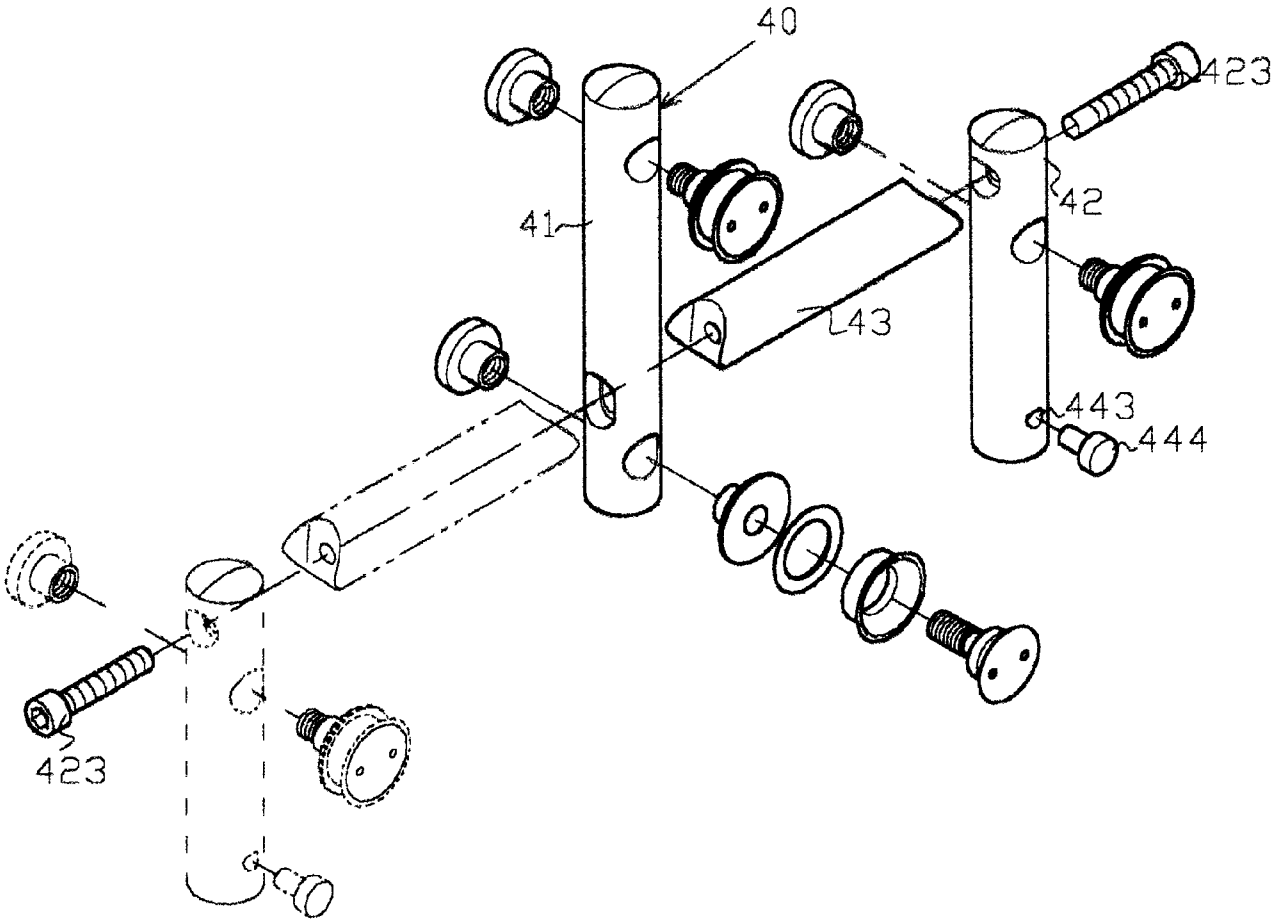
FIG. 8 is an exploded view of the invention in another use condition, with the anchor assembly altered.

Refer to FIGS. 7, 8 and 9 for the invention adopted on a single door that is opened in another different direction. The first transverse rod 32 and the pivotal strut 33 are installed and fastened to another side. The second transverse rod 43 and the third vertical rod 42 also are moved and fastened to another side.

Figure 10:
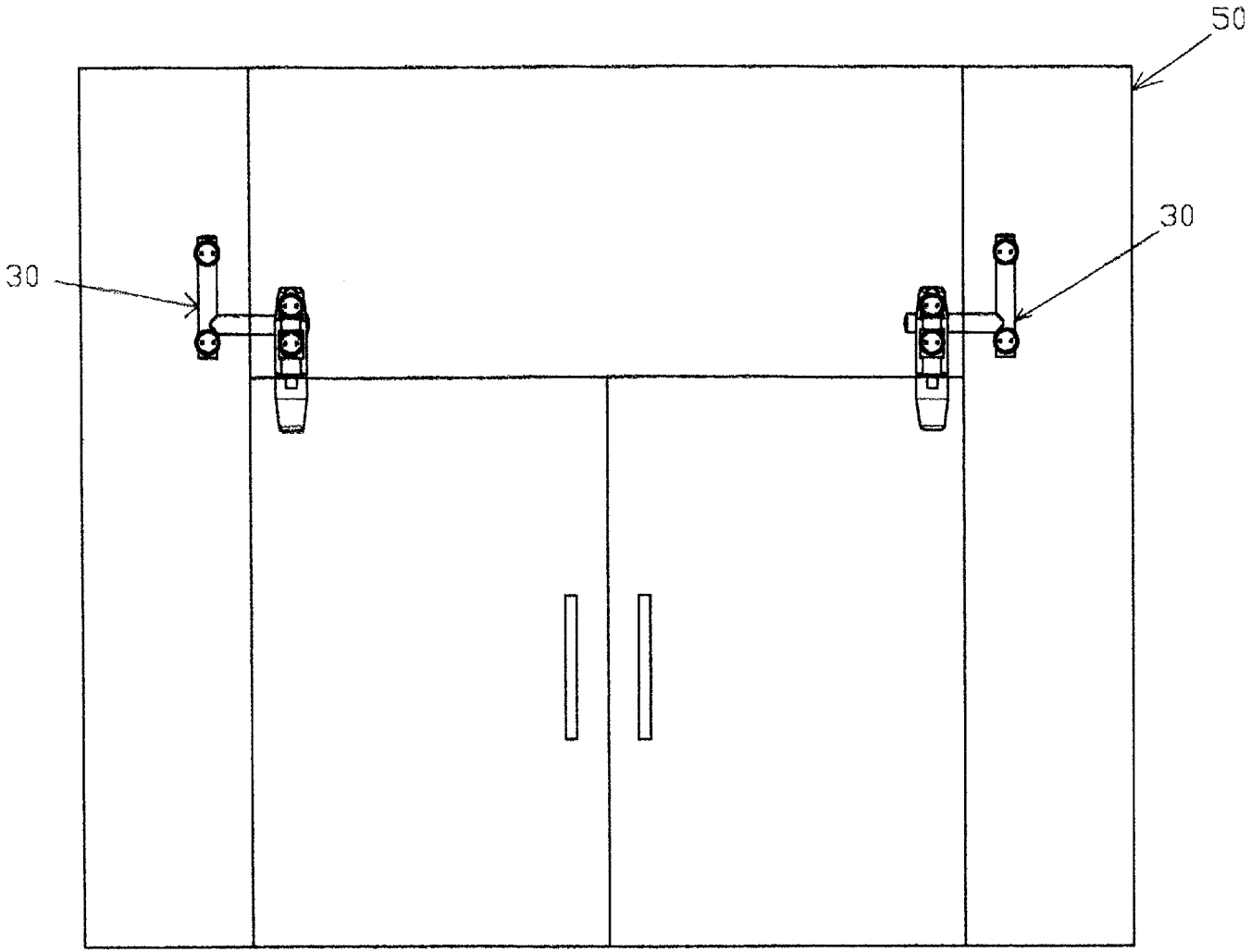
FIG. 10 is a schematic view of another variation of the invention in a use condition.

Refer to FIG. 10 for the invention adopted on double doors. Two sets of the pivotal strut assembly 30 are fastened to two sides of the doors.

In summary, the invention offers the following advantages:

1. The vertical rods, transverse rods and pivotal strut of the invention are made firm cylindrical bars by lathe machining without using molds. Materials are easy to procure and production cost can be greatly reduced. The lathe machining also can speed up production.
2. The transverse holes and stepwise holes of the vertical rods are bi-directional and have fastening function in two directions. Thus the invention may be switched between the right side and the left side. Installation flexibility and interchangeability increase, and production and warehousing costs and space may be reduced.
3. The diameters of the apertures on the vertical rods are greater than the diameters of the fastening bolts of the anchor means. Thus in the event of gaps occurred between the tempered glass panels, the invention may be adjusted to accurately hold and anchor the tempered glass.
4. The pivotal strut may be moved freely on the first transverse rod to eliminate the gap occurred between, the tempered glass panels to achieve accurate fastening of the invention to the tempered glass.
5. The first and the second vertical rods are identical. Thus interchange flexibility increases. This also helps to reduce production and warehousing costs and space.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An adjustable top holder comprising a pivotal strut assembly and an anchor assembly that consist of a plurality of anchor means and a plurality of anchor disks for protecting and anchoring a tempered glass which includes a plurality of glass panels, wherein:

each of the anchor means has a fastening bolt coupled with a protective ring, a washer and an anchor bushing;

each of the anchor disks has a screw hole to engage with the fastening bolt of the anchor means;

the pivotal strut assembly includes:

a first vertical rod which has a first aperture, and a second aperture located on desired positions for fastening respectively one anchor means and one anchor disk, and a transverse hole located between the first aperture and the second aperture, the first aperture and the second apertures having a diameter greater than the diameter of the fastening bolt, the transverse hole being an extended round stepwise hole;

a first transverse rod which has one end formed a trough and a screw hole for fastening to the first vertical rod through a set screw in a cross manner; and a pivotal strut having a first screw hole and a second screw hole located on desired positions for fastening respectively one anchor means, and a through hole between the first and the second screw holes, the first transverse rod being run through the through hole until reaching a desired position and being fastened by another set screw; and the anchor assembly includes:

a second vertical rod which has a third aperture and a fourth aperture located on desired positions for fastening the anchor means and the anchor disk, and a transverse hole located between the third aperture and the fourth aperture, the third aperture and the fourth apertures having a diameter greater than the diameter of the fastening bolt;

a third vertical rod which has a fifth aperture located at a desired position with a diameter greater than the diameter of the fastening bolt for fastening the anchor means and the anchor disk, and a first stepwise hole located on an upper portion thereof; and a second transverse rod located between the second and the third vertical rods having two ends formed respectively a trough and a screw hole to fasten to the second and the third vertical rods through set screws to bridge the second transverse rod between the second and the third vertical rods.

2. The adjustable top holder of claim 1, wherein the third vertical rod is extended downwards to form a fourth vertical rod which has an aperture located on a lower section thereof to engage with a stop pad.

3. The adjustable top holder of claim 1, wherein the pivotal strut has a bottom end formed a cavity for holding an axle which is fastened by a set screw.

4. The adjustable top holder of claim 1, wherein the transverse hole on the first vertical rod and the second vertical rod is an extended round bi-directional stepwise hole.

5. The adjustable top holder of claim 1, wherein the first stepwise hole on the third vertical rod and the fourth vertical rod is bi-directional and stepwise.

* * * * *